US006145658A

United States Patent [19]

Donohoe et al.

[11] Patent Number: 6,145,658

[45] Date of Patent: Nov. 14, 2000

[54] PACKAGING ASSEMBLY

[75] Inventors: Daniel J. Donohoe, Upland, Calif.; Charles E. Wonhof, Minneapolis; Lewis F. Roberts, Oakdale, both of Minn.

[73] Assignee: Leucadia, Inc., New York, N.Y.

[21] Appl. No.: 09/276,313

[22] Filed: Mar. 25, 1999

[51] Int. Cl.[7] ..... B65D 85/00

[52] U.S. Cl. ..... 206/215; 206/449; 229/120.09

[58] Field of Search ..... 206/215, 326, 206/425, 449, 485, 494, 515, 518; 229/120.03, 120.09

[56] References Cited

U.S. PATENT DOCUMENTS

| | | | |
|---|---|---|---|
| 78,715 | 6/1868 | Armour | 229/120.09 |
| 383,537 | 5/1888 | Osborn . | |
| 1,077,322 | 11/1913 | Ward . | |
| 1,657,942 | 1/1928 | Spaldo | 206/215 |
| 1,962,920 | 6/1934 | Trautz . | |
| 1,999,664 | 4/1935 | Reaume . | |
| 2,046,484 | 7/1936 | Ringler . | |
| 2,085,649 | 6/1937 | Gluck | 206/215 |
| 2,313,747 | 3/1943 | Holm . | |
| 2,333,416 | 11/1943 | Ducey . | |
| 2,348,041 | 5/1944 | Warner . | |
| 2,360,931 | 10/1944 | Brockman . | |
| 3,209,941 | 10/1965 | Krake | 206/449 |
| 3,237,841 | 3/1966 | Ridgeway, Jr. | 229/120.09 |
| 3,482,734 | 12/1969 | Mierson . | |
| 3,596,798 | 8/1971 | Smith . | |
| 4,413,769 | 11/1983 | Michetti . | |
| 5,261,533 | 11/1993 | Adams et al. | 229/120.09 |

FOREIGN PATENT DOCUMENTS

| | | |
|---|---|---|
| 2 605 599 A | 4/1988 | France . |
| 296 19 064 U | 3/1997 | Germany . |
| 6 507 240 A | 2/1966 | Netherlands . |
| 1 204 091 A | 9/1970 | United Kingdom . |
| 2 167 390 A | 5/1986 | United Kingdom . |

*Primary Examiner*—Paul T. Sewell
*Assistant Examiner*—Luan K. Bui
*Attorney, Agent, or Firm*—Vidas, Arrett & Steinkraus

[57] ABSTRACT

Packaging assemblies having two side-by-side compartments are made from a tray and two cover portions. The compartments are designed to hold sheets of material. The packaging assemblies may also be provided in a kit comprising a tray blank and two cover portions or a tray blank and two cover blanks.

14 Claims, 5 Drawing Sheets

PACKAGING ASSEMBLY

BACKGROUND OF THE INVENTION

The present invention is directed to a carton for transporting sheeted material in general and sheeted insulators for mattresses in particular.

Sheeted products are typically shipped in boxes, one stored on top of the other. During transit, when the box is stored on its end, the sheeted products tend to fall to the bottom of the box and become tangled. Sometimes, as a result of the handling of the box or a shifting of the contents, the box will burst open spilling its content.

In the mattress factory, sheeted products such as insulators tend to be piled one on top of the other in large, loose piles occupying significant amounts of space. In retrieving sheeted insulators from such piles, the worker is subject to back stress and strain.

It is a goal of the present invention to provide a packaging assembly which allows for the storage of sheeted material without the accompanying entanglement of the material during transit.

It is a further goal of the present invention to provide a storage medium for sheeted materials which provides sheeted materials in an ergonomically sound way while reduce the amount of space currently allocated to the storage of such materials.

The present invention provides a package assembly which is designed to address these needs. The present invention also provides a kit for produce the inventive package assembly. The present invention also provides a method for packaging sheeted material.

For the purposes of this application, the tem rectangular shall refer to both rectangles and squares.

BRIEF SUMMARY OF THE INVENTION

In one embodiment, the invention is directed to a box having a first and a second rectangular compartment disposed side-by-side. Each compartment has a top side and a bottom side and an interior side and an exterior side. The exterior side extends from the top side to the bottom side while the interior side extends only a portion of the way from the bottom side to the top side. Each compartment further has two side walls. Each side wall extends between the interior side and the exterior side and between the top side and the bottom side. The compartments are disposed side-by-side with the interior sides arranged back-to-back. The interior sides are formed of a single piece of material folded over on itself. The first and second compartments are interconnected between the top of the interior sides and the top sides of the compartments.

In another embodiment, the present invention is directed to a package assembly kit. The kit comprises a tray and first and second covers. The tray comprises a four sided substantially flat bottom portion and four bottom walls extending therefrom. Adjacent sides of the bottom portion are disposed at a right angle relative to one-another. The bottom portion has a score thereon along a line extending between two opposing sides through the middle of the flat bottom portion. Each of the bottom walls extend upward from a different side of the bottom portion and is disposed at a right angle relative to the bottom portion. Adjacent bottom walls are disposed perpendicular to one another. Two opposing bottom walls have a cut therethrough adjacent to the score along the bottom portion.

The first and second covers each comprise a four sided substantially flat top portion and three top walls. Adjacent sides of the top portion are disposed at a right angle relative to one-another. Each top wall extends downward from a different side of the top portion and is disposed at a right angle relative to the top portion. Adjacent top walls are disposed perpendicular to one another. The fourth side of the top portion is a non-walled side and has a first score thereon so as to be foldable along its length to form a flap.

In yet another embodiment, the invention is directed to a method of packaging sheet-like material using the inventive packaging assemblies. The method comprises the steps of providing an inventive package assembly including a tray portion with a score across the middle and two portions and placing a selected number of sheet-like materials in the tray. Each of the first and second covers are placed on the tray and secured thereto. A lifting apparatus is provided and arranged relative to the bottom portion of the tray such that the lifting apparatus registers with at least a portion of the score along the bottom portion of the tray. The lifting apparatus and first and second end portions of the tray are moved relative to one another so as to bend the bottom portion of the tray about the score thereon until the top portion of the first cover and the top portion of the second cover are substantially parallel to one another and displaced from one another and the bottom portion is folded over on itself. As a result, the first half of the bottom portion and the second half of the bottom portion are substantially parallel to one another and disposed in-between the top portion of the first cover and the top portion of the second cover.

BRIEF DESCRIPTION OF THE SEVERAL VIEWS OF THE DRAWING(S)

Figure 4A:
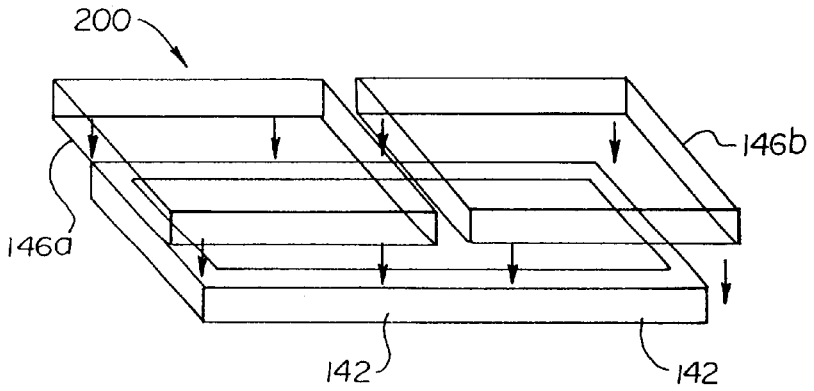
Figure 4B:
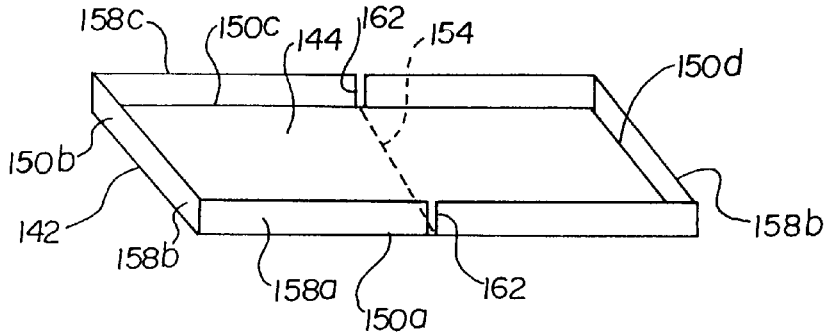
Figure 4C:
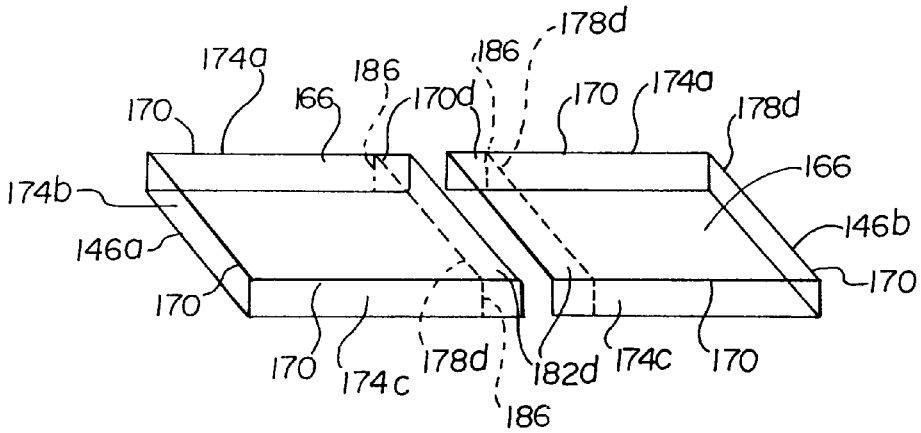
Figure 5A:
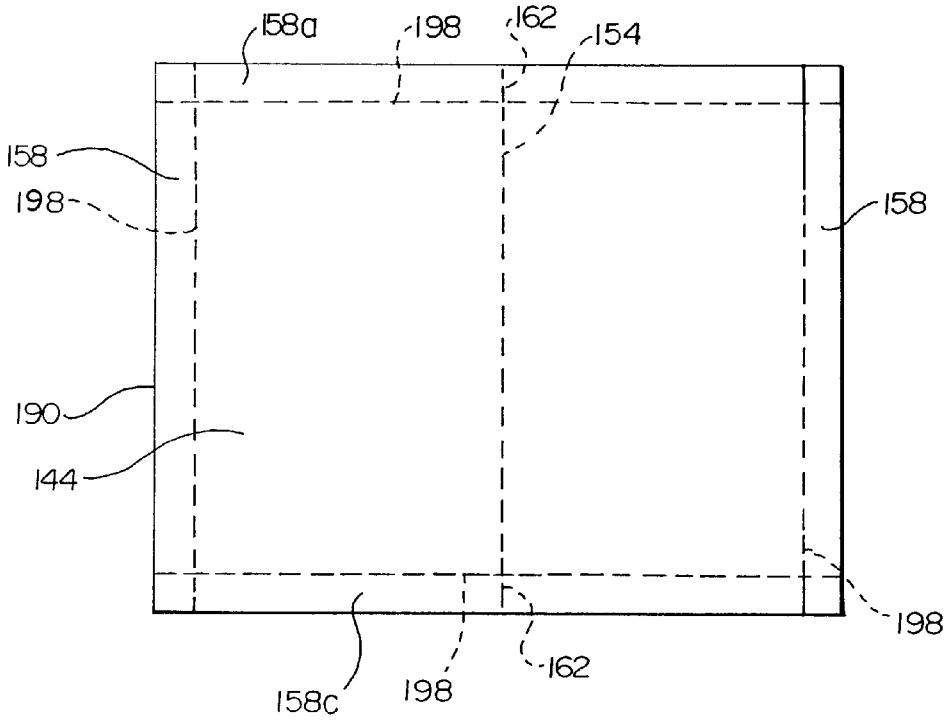
Figure 5B:
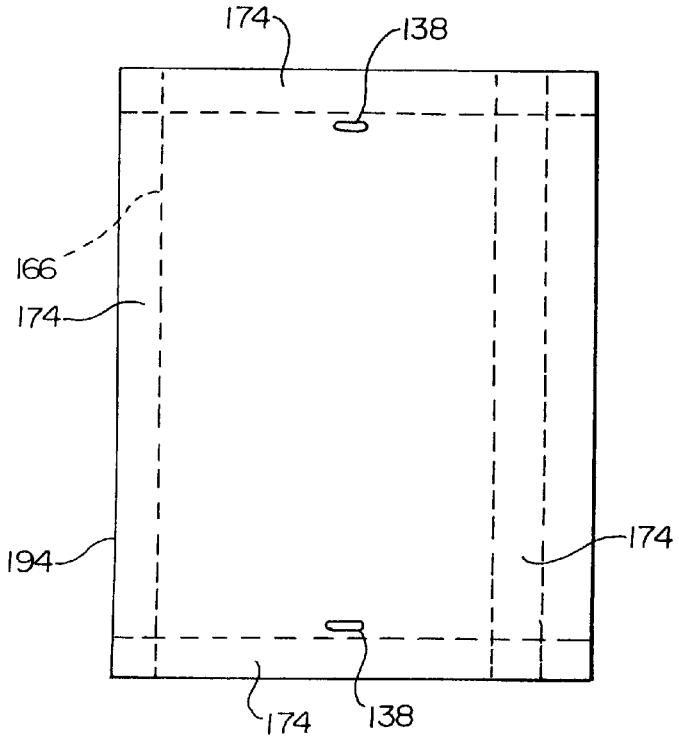
Figure 6:
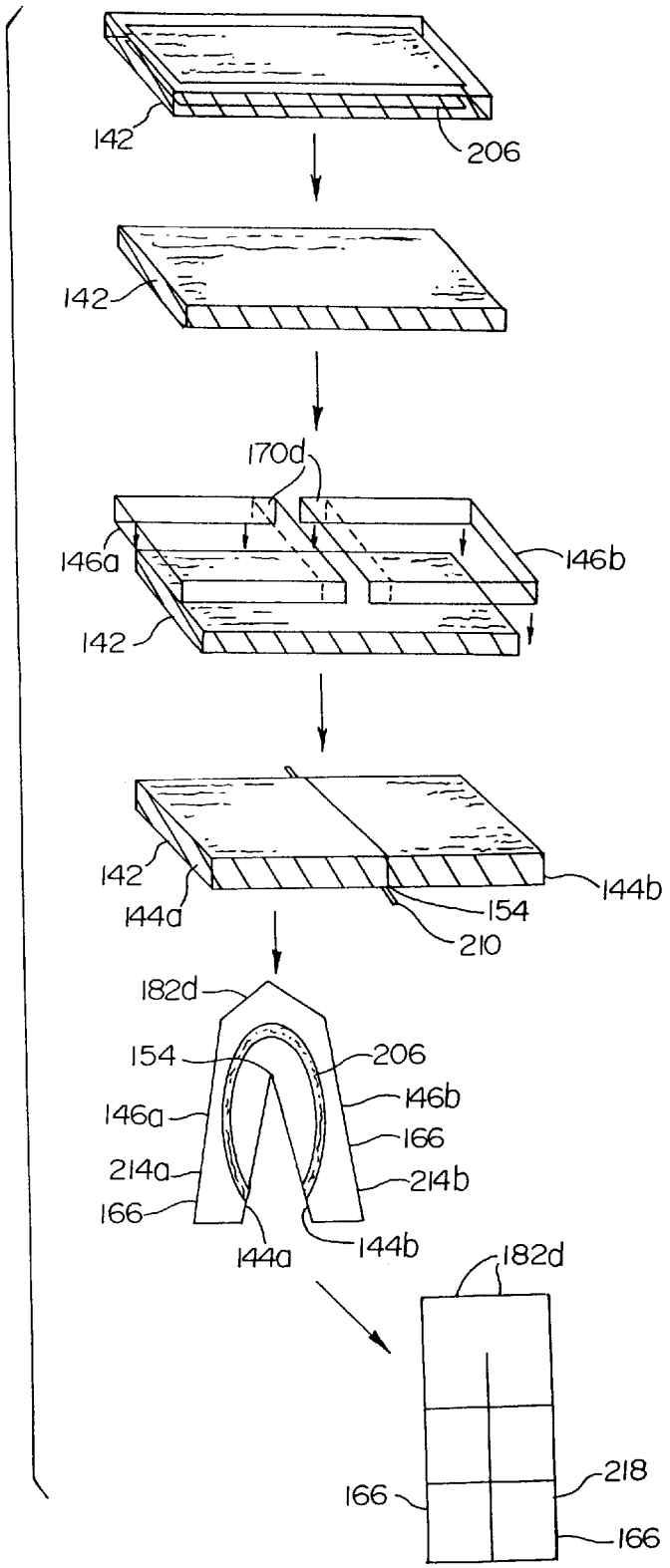
Figure 7:
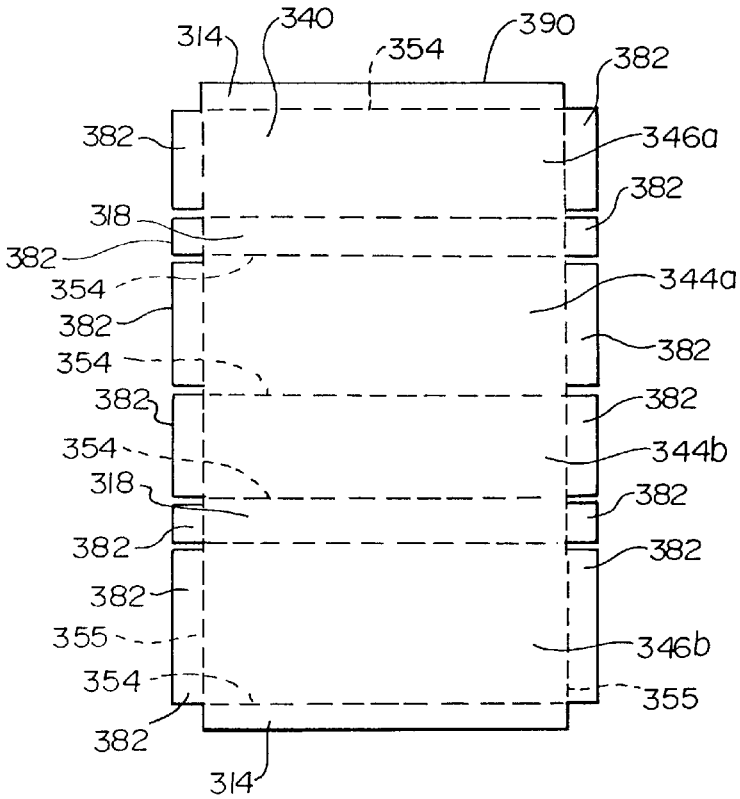
Figure 8:
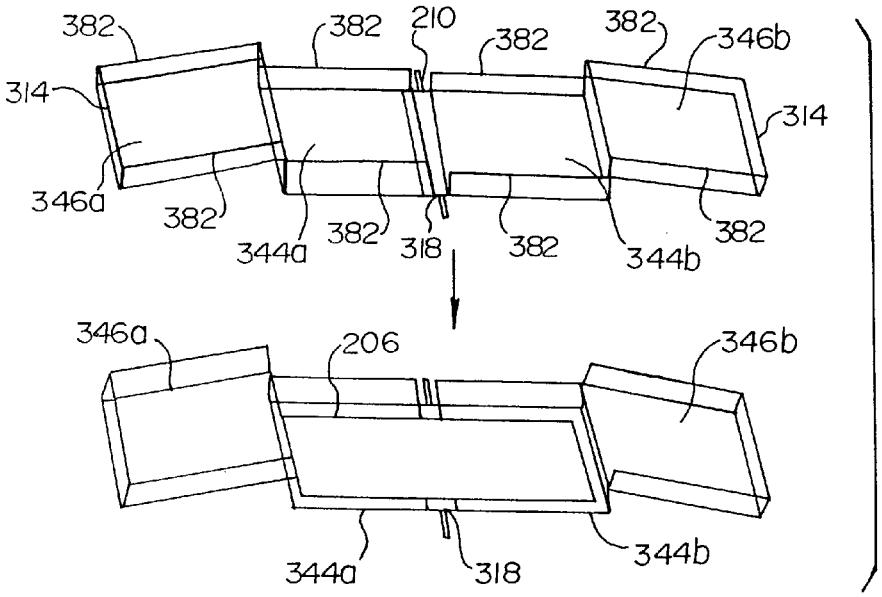

FIG. 4*a* is an exploded perspective view of the bottom and top portions of an inventive box;

FIG. 4*b* is a perspective view of the bottom portion of an inventive box;

FIG. 4*c* is a perspective view of the top portions of an inventive box;

FIG. 5*a* is a plan view of the blank from which the bottom portion is formed;

FIG. 5*b* is a plan view of the blank from which the top portions are formed;

FIG. 6 is a schematic depicting the inventive packaging method;

FIG. 7 is a plan view of another blank from which an inventive one-piece box is formed; and FIG. 8 is a schematic depicting another embodiment of the inventive packaging method.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

Figure 1:
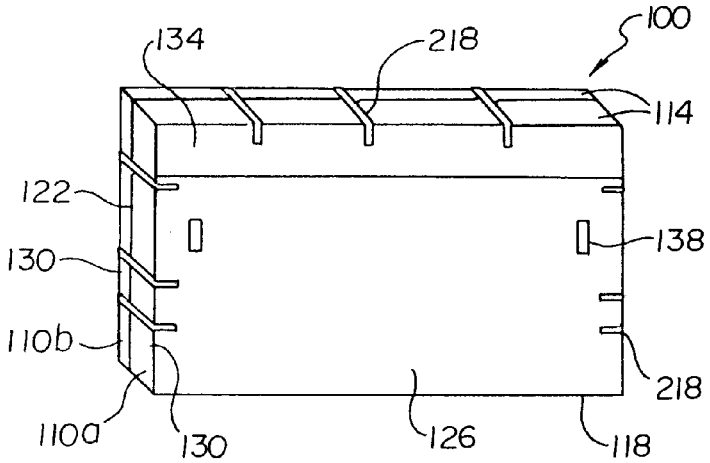
FIG. 1 is a perspective view of a closed box embodying features of the inventions.
Figure 2:
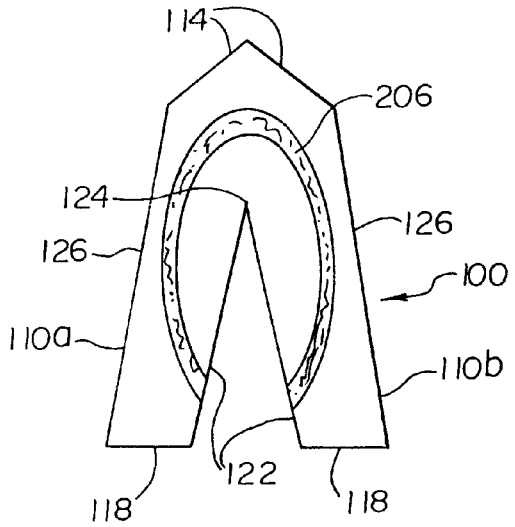
FIG. 2 is a sectional view of a partially folded box.

In one embodiment, the present invention is directed to a box, shown generally at 100 in FIG. 1 in a closed configuration and in FIG. 2 in the partially closed configuration. Box 100 has a first rectangular compartment 110*a* and a second rectangular compartment 110*b*. Each compartment has a top side 114 and a bottom side 118, an interior side 122 and an exterior side 126. Exterior sides 126 extend from top side 114 to bottom side 118. Interior sides 122 extend only a portion of the way from bottom side 118 to top side 114. Each compartment further has two oppositely disposed side walls 130. Each side wall 130 extends between interior side 122 and exterior side 126 and between top side 114 and bottom side 118.

Figure 3:
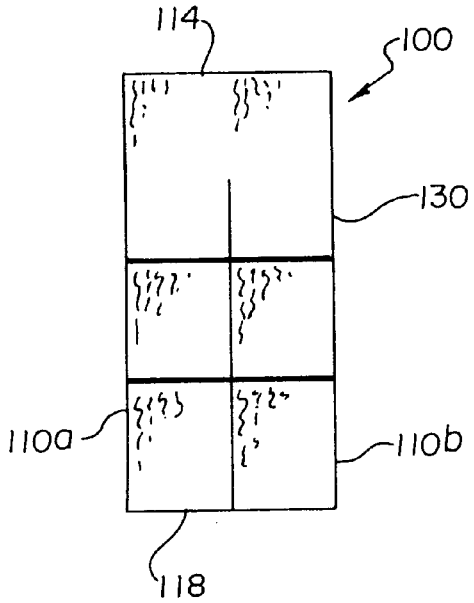
FIG. 3 is a side view of the box of FIG. 1.

Compartments 110*a,b* are disposed side-by-side with interior sides 122 arranged back-to-back. Interior sides 122 are formed of a single piece of material folded over on itself. In the partially and fully closed configurations, as shown in FIGS. 1–3, interior sides 122 provide a support on which sheeted material 206 may rest. First and second compartments 110*a,b* are interconnected between the top 124 of interior sides 122 and top sides 114 of the compartments.

The length of first and second compartments 110*a,b*, as defined by the distance between top side 114 and bottom side 118, may optionally exceed the width of the compartment, as defined by the distance between side walls 130 of the compartment.

Optionally, the inventive box may have a scored openable portion such as a removable cut-out portion 134 in at least one of exterior sides 126 to facilitate removal of materials from the box. Cut-out portion may be as shown in FIG. 1 or may be of some other suitable shape.

Each of exterior sides 126 may have a handle 138. Desirably, the handle is an opening through exterior sides 126 adjacent to top side 114. Other suitable handles, as are known in the art, may also be used.

In another embodiment, as shown generally at 200 in FIG. 4*a*, the invention is directed to a package assembly kit comprising a tray 142 and first and second covers 146*a,b*.

As shown in FIG. 4*b*, tray 142 comprises a four sided substantially flat bottom portion 144. Adjacent sides 150*a–d* of bottom portion 144 are disposed at a right angle relative to one-another. Bottom portion 144 has a score 154 thereon along a line extending between two opposing sides 150*a,c* through the middle of flat bottom portion 144. Four bottom walls 158*a–d* extend upward from bottom portion 144. Each wall extends from a different side of the bottom portion and is disposed at a right angle relative to the bottom portion. Adjacent bottom walls are disposed perpendicular to one another. Two opposing bottom walls 158*a,c* each have a cut 162 therethrough adjacent to score 154.

As shown in FIG. 4*c*, first and second covers 146*a,b* each comprise a four sided substantially flat top portion 166. Adjacent sides 170 of top portion 166 are disposed at a right angle relative to one-another. First and second covers 146*a,b* further comprise three top walls 174*a–c*. Each top wall 174 extends downward from a different side of top portion 166 and is disposed at a right angle relative to the top portion. Adjacent top walls 174 are disposed perpendicular to one another. Fourth side 170*d* of top portion 166 is a non-walled side and has a first score 178*d* thereon so as to be foldable along its length to form a flap 182*d*.

Desirably, each of bottom portion 144 of tray 142 and top portion 166 of first and second covers 146*a,b* are rectangular. The length of the bottom portion desirably exceeds the width of the bottom portion and the width of each top portion desirably exceeds the length of each top portion. Also desirably, scoring 154 on bottom portion 144 extends along the width of bottom portion 144.

The invention also contemplates the possibility that at least one of the bottom portion and top portions of first and second covers are square.

As shown in the figures, each of bottom wall portions 158*a–d* are of the same height. The combined length of first and second covers 146*a,b* is at least equal to about the sum of the length of bottom portion 144 of the tray 142 and twice the height of bottom wall portion 158. The combined length of the first and second covers may also be slightly greater than the sum of the length of the bottom portion of the tray and twice the height of a bottom wall portion such that the flaps 182*d* overlap.

The width of the first and second cover portions 146*a,b* may be chosen to as to be slightly greater than or slightly less than the width of bottom portion 144. Desirably, the cover portion will be sized with a width slightly larger than that of the tray.

It is also desirable that top walls 174*a,c* which are opposed to one another each have a cut 186 therein adjacent to score 178 along top portion 166.

In yet another embodiment, the invention is directed to a package assembly kit comprising a tray blank 190, as shown in FIG. 5*a* and first and second cover blanks 194 as shown in FIG. 5*b*. Tray blank 190, a flat substrate, is used to form a tray therefrom. Similarly, the first and second cover blanks, each flat substrates, are used to form first and second covers.

Tray blank 190 has a rectangular portion 144. Each side of rectangular portion 144 has a foldable flap 158 extending therefrom. The intersection of a given flap 158 with a given side of rectangular portion 144 is scored 198. Desirably, each flap 158 is substantially the same length as the side from which it extends. Two opposing flaps 158*a,c* each have a cut 162 therethrough. Each cut 162 extends outward in a perpendicular direction from scored region 198 along the width of the flap. Cut 162 is disposed midway along the length of the flap. Flaps 158 are all independently foldable.

Rectangular portion 144 further has a score 154 thereon extending at least a portion of the way between cuts 162 on opposing flaps 158*a,c*.

Tray blank 190 is easily assembled into tray 142 by folding flaps 158 upward and securing adjacent flaps to one-another.

First and second cover blanks 194 each have a rectangular cover portion 166. Each side of cover portion 166 has a foldable flap 174 extending therefrom. The intersection of a given flap 174 with a given side of rectangular cover portion 166 has a score 178.

Each of the first and second cover blanks is characterized by a length and a width. The sum of the length of the first and second cover blanks is at least equal to about the length of the tray blank. Desirably, the sum of the length of the first and second cover blanks is slightly greater than the length of the tray blank.

Also desirably, the widths of the first and second cover blanks are substantially equal to the width of the tray blank or slightly wider than the width of the tray blank.

As with the above embodiments, at least one of the first and second cover blanks may have a scored openable portion such as a removable cut-out portion. Further, each of the cover blanks may have a handle proximate to one of the flaps.

In another embodiment, the present invention is directed to a method of packaging sheet-like materials. As shown in FIG. 6, a package assembly comprising a tray 142 and first and second cover portions 146*a,b* as described above are provided. A selected number of sheet-like materials 206 are placed in tray 142. Each of first and second covers 146*a,b* are placed on tray 142 such that fourth side 170*d* of both the first and second covers are adjacent and opposite to one-another. First and second covers 146*a,b* are then secured to tray 142 adhesively, through the use of staples, tacks or nails, through the use of tape or through any other suitable method.

A lifting apparatus 210 is provided. Lifting apparatus 210 may be a bar or a rod or may be any other suitable lifting means such as a modified fork lift. Bottom portion 144 of tray 142 and lifting apparatus 210 are arranged such that lifting apparatus 210 registers with at least a portion of score 154.

Lifting apparatus 210 and first and second end portions 214*a,b* are moved relative to one another so as to bend bottom portion 144 of tray 142 about score 154 thereon such that top portion 166 of first cover 146*a* and 166 top portion of second cover 146*b* are substantially parallel to one another and displaced from one another and such that bottom portion 144 is folded over on itself with the first half 144*a* of the bottom portion and second half 144*b* of the bottom portion substantially parallel to one another and disposed in-between the top portion 166 of first cover 146*a* and top portion 166 of second cover 146*b*.

The method may further comprise the steps of folding flap portions 182*d* of first and second covers 146*a,b* downward. Flap portions 182*d* may then be secured to the package assembly, either to one another or to the tray or to both.

Lifting apparatus 210 may then be removed from contact with the package assembly.

The packaging assembly may be further secured via the application of strapping material 218 about the package assembly after the lifting step and desirably, after the removal of the lifting apparatus.

In another embodiment, the invention is directed to a box formed from blank 390 shown in FIG. 7. Blank 390 has a rectangular portion 340. Rectangular portion 340 is subdivided into a first and second bottom portions 344*a,b,* first and second cover portions 346*a,b* and top side 314 and bottom side 318. Adjacent subdivisions of rectangular portion 340 are separated by scores 354. Each of the subdivisions has two opposing foldable flaps 382 extending therefrom. Flaps 382 are separated from the rectangular subdivisions by scores 355 extending along the length of rectangular portion 340.

It will be recognized by those of ordinary skill in the art that the blank of FIG. 7 may be modified by eliminating either the opposing flaps extending off of bottom portions 344*a,b* or by eliminating the opposing flaps extending off of cover portions 346*a,b*. It will also be recognized that the blank may include any of the other features disclosed above, including cut-out portions and handles.

The assembly of a box and use of the box assembled from blank 390 is shown in FIG. 8. Flaps 382 are folded up and lift bar 210 inserted under bottom side 318. Lift bar 318 is inserted under bottom portion along score 354 and sheeted material 206 is loaded on bottom portion 344*a,b*. Cover portions 346*a,b* may be closed and secured to the remainder of the box. Other portions of the box may also be secured. Lift bar 318 is lifted so as to fold rectangular portion 340 over on itself so as to resemble the folded over box shown in FIG. 6. The resulting box resembles that shown in FIG. 1 and has the advantage of being formed from a single blank.

In another embodiment of the invention, the blank of FIG. 7 is cut along score 354 and provided in two pieces. At the point of use, the two pieces are joined together, such as by taping and the box prepared as described above.

Among the many advantages of the present invention, it is noted that using the bottom portion of the tray as an interior support for sheeted material in the folded packaging assembly allows for the provision of such a support member without the necessity of adding a separate support member to the packaging assembly. By eliminating the need for an insert, this feature reduces the weight of the packaging and allows for faster assembly of the packaging.

The inventive boxes and blanks for use in the present invention may be made of paper and fiber products such as corrugated cardboard, plastics and composites. Those of ordinary skill in the art will recognize other suitable substrates for use in the inventive packaging.

The inventive packaging may be used to store sheet-like material such as sheet-like insulators for mattresses. The inventive packaging may also be used to store and dispense other sheet-like materials as well such as, scrims, webs, bats, pads and any other flat, bendable material.

The above disclosure is intended to be illustrative and not exhaustive. This description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A box having a first and a second rectangular compartment, each compartment having 1) a top side and a bottom side, 2) an interior side and an exterior side, the exterior side extending from the top side to the bottom side, the interior side extending only a portion of the way from the bottom side to the top side, 3) two opposing side walls, each side wall extending between the interior side and the exterior side, each side wall extending between the top side and the bottom side the compartments disposed side-by-side with the interior sides arranged back-to-back, the interior sides formed of a single piece of material folded over on itself, the first and second compartments interconnected between the top of the interior sides and the top sides of the compartments, wherein adjacent side walls of the first compartment and second compartment are separated by a gap.

2. The box of claim 1 where the length of the first and second compartments, as defined by the distance between the top side and the bottom side, exceeds the width of the compartment, as defined by the distance between the side walls of the compartment.

3. The box of claim 1 made from a paper-product.

4. The box of claim 1 made from corrugated cardboard.

5. The box of claim 1 wherein at least one of the first and second exterior sides and top sides has a removable cut-out portion therein to facilitate removal from the box.

6. The box of claim 1 wherein each of the exterior sides have a handle.

7. The box of claim 6 wherein the handle is an opening through the exterior side, the opening adjacent to the top side.

8. The box of claim 1 containing sheet-like material.

9. The box of claim 8 wherein the sheet-like material is in the form of sheet-like insulators for mattresses.

10. The box of claim 8 wherein the single piece of material which is folded over on itself supports the sheet-like material.

11. The box of claim 8 wherein the sheet-like material is draped over the single piece of material which is folded over on itself.

12. The box of claim 8 formed by providing a tray, placing sheet-like materials flat on the tray, placing a first cover on a first portion of the tray and a second cover on a second portion of the tray, the first and second covers covering the tray, and causing the base member to fold over on itself.

13. A box having a first and a second rectangular compartment, each compartment having 1) a top side and a bottom side, 2) an interior side and an exterior side, the exterior side extending from the top side to the bottom side, the interior side extending only a portion of the way from the bottom side to the top side, 3) two opposing side walls, each side wall extending between the interior side and the exterior side, each side wall extending between the top side and the bottom side the compartments disposed side-by-side with the interior sides arranged back-to-back, the interior sides formed of a single piece of material folded over on itself, the first and second compartments interconnected between the top of the interior sides and the top sides of the compartments, wherein adjacent side walls of the first compartment and second compartment are discontinuous.

14. The box of claim 13 where the length of the first and second compartments, as defined by the distance between the top side and the bottom side, exceeds the width of the compartment, as defined by the distance between the side walls of the compartment.

* * * * *

UNITED STATES PATENT AND TRADEMARK OFFICE
CERTIFICATE OF CORRECTION

PATENT NO. : 6,145,658

DATED : November 14, 2000

INVENTOR(S) : Daniel J. Donohoe, Charles E. Wonhof and Lewis E. Roberts

It is certified that error appears in the above-identified patent and that said Letters Patent is hereby corrected as shown below:

On title page, in the section titled "Inventors", third line, please delete "F" and insert --E--.

Column 1, line 26, please delete "reduce" and insert --reducing--.

Column 1, line 30, please delete "produce" and insert --producing--.

Column 1, line 33, please delete "tem" and insert --term--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*